US006046705A

United States Patent [19]

Anderson

[11] Patent Number: 6,046,705

[45] Date of Patent: Apr. 4, 2000

[54] STANDING WAVE PLASMA ANTENNA WITH PLASMA REFLECTOR

[75] Inventor: Theodore R. Anderson, West Greenwich, R.I.

[73] Assignee: The United States of America as represented by the Secretary of the Navy, Washington, D.C.

[21] Appl. No.: 09/317,084

[22] Filed: May 21, 1999

[51] Int. Cl.[7] ..... H01Q 19/10; H01Q 1/26

[52] U.S. Cl. ..... 343/834; 343/701

[58] Field of Search ..... 343/701, 785, 343/709, 834; 315/111.21, 111.41

[56] References Cited

U.S. PATENT DOCUMENTS 5,963,169 10/1999 Anderson et al. ..... 343/701

5,990,837 11/1999 Norris et al. ..... 343/701

*Primary Examiner*—Don Wong

*Assistant Examiner*—Tan Ho

*Attorney, Agent, or Firm*—Michael J. McGowan; Robert W. Gauthier; Prithvi C. Lall

[57] ABSTRACT

A standing wave plasma antenna is provided. An ionizer generates an ionizing beam in a bounded plasma column extending along a vertical axis. A modulating signal is applied to an electro-optical crystal that modulates the ionizing beam. The resulting changes in the ionizing beam produce gradients in the plasma that cause ions and electrons to oscillate in a vertical path that generates alternating current having the frequency of the modulator. At a remote end the antenna terminates in a reflector. The reflector includes a chamber having a plasma with a charged particle density that is greater than the charged particle density in the plasma. The generated currents are therefore reflected as in a standing wave antenna. These currents generate an amplitude-, phase- or frequency-modulated electromagnetic field that radiates from the plasma column.

19 Claims, 3 Drawing Sheets

STANDING WAVE PLASMA ANTENNA WITH PLASMA REFLECTOR

CROSS REFERENCES TO RELATED PATENT APPLICATION

The instant application is related to two co-pending U.S. Patent Applications entitled PLASMA ANTENNA WITH TWO-FLUID IONIZATION CURRENT (Navy Case No. 78767); and PLASMA ANTENNA WITH ELECTRO-OPTICAL MODULATOR (Navy Case No. 78773) having same filing date.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to communications antennas, and more particularly to plasma antennas adaptable for use in any of a wide range of frequencies.

(2) Description of the Prior Art

A specific antenna typically is designed to operate over a narrow band of frequencies. However, the underlying antenna configuration or design may be adapted or scaled for widely divergent frequencies. For example, a simple dipole antenna design may be scaled to operate at frequencies from the 3–4 MHz band up to the 100 MHz band and beyond.

At lower frequencies the options for antennas become fewer because the wavelengths become very long. Yet there is a significant interest in providing antennas for such lower frequencies including the Extremely Low Frequency (ELF) band, that is less than 3 kHz, the Very Low Frequency (VLF) band including signals from 20 kHz to 60 kHz and the Low Frequency (LF) band with frequencies in the 90 to 100 kHz band. However, conventional half-wave and quarter-wave antenna designs are difficult to implement because at 100 Hz, for example, a quarter-wave length is of the order of 750 km.

Notwithstanding these difficulties, antennas for such these frequencies are important because they are useful in specific applications, such as effective communications with a submerged submarine. For such applications, conventional ELF antennas comprise extremely long, horizontal wires extended over large land areas. Such antennas are expensive to construct and practically impossible to relocate at will. An alternative experimental Vertical Electric Dipole (VEP) antenna uses a balloon to raise one end of a wire into the atmosphere to a height of up to 12 km or more. Such an antenna can be relocated. To be truly effective the antenna should extend along a straight line. Winds, however, can deflect both the balloon and wire to produce a catenary form that degrades antenna performance. Other efforts have been directed to the development of a corona mode antenna. This antenna utilizes the corona discharges of a long wire to radiate ELF signals.

Still other current communication methods for such submarine and other underwater environments include the use of mast mounted antennas, towed buoys and towed submersed arrays. While each of these methods has merits, each presents problems for use in an underwater environment. The mast of current underwater vehicles performs numerous sensing and optical functions. Mast mounted antenna systems occupy valuable space on the mast which could be used for other purposes. For both towed buoys and towed submersed arrays, speed must be decreased to operate the equipment. Consequently, as a practical matter, the use of such antennas for ELF or other low frequency communications is not possible because they require too much space.

Conventional plasma antennas are of interest for communications with underwater vessels since the frequency, pattern and magnitude of the radiated signals are proportional to the rate at which the ions and electrons are displaced. The displacement and hence the radiated signal can be controlled by a number of factors including plasma density, tube geometry, gas type, current distribution, applied magnetic field and applied current. This allows the antenna to be physically small, in comparison with traditional antennas. Studies have been performed for characterizing electromagnetic wave propagation in plasmas. Therefore, the basic concepts, albeit for significantly different applications, have been investigated.

With respect to plasma antennas, U.S. Pat. No. 1,309,031 to Hettinger discloses an aerial conductor for wireless signaling and other purposes. The antenna produces, by various means, a volume of ionized atmosphere along a long beam axis to render the surrounding atmosphere more conductive than the more remote portions of the atmosphere. A signal generating circuit produces an output through a discharge or equivalent process that is distributed over the conductor that the ionized beam defines and that radiates therefrom.

U.S. Pat. No. 3,262,118 to Jones discloses a scanning antenna. Rf energy in the gigahertz range is coupled through waveguide to a tapered load that prevents reflections. A tube located within the waveguide forms a bounded plasma cavity. Varying the current in coils controlling the excitation of the plasma alters the phase relationship of the rf energy.

U.S. Pat. No. 3,404,403 to Vellase et al. uses a high power laser for producing the laser beam. Controls repeatedly pulse and focus the laser at different points thereby to ionize a column of air. Like the Hettinger patent, a signal is coupled onto the ionized beam.

U.S. Pat. No. 3,719,829 to Vaill discloses an antenna constructed with a laser source that establishes an ionized column. Improved ionization is provided by means of an auxiliary source that produces a high voltage field to increase the initial ionization to a high level to form a more highly conductive path over which useful amounts of electrical energy can be conducted for the transmission of intelligence or power. In the Hettinger, Vellase et al. and Vaill patents, the ionized columns merely form vertical conductive paths for a signal being transmitted onto the path for radiation from that path.

U.S. Pat. No. 3,914,766 to Moore discloses a pulsating plasma antenna, which has a cylindrical plasma column and a pair of field exciter members parallel to the column. The location and shape of the exciters, combined with the cylindrical configuration and natural resonant frequency of the plasma column, enhance the natural resonant frequency of the plasma column, enhance the energy transfer and stabilize the motion of the plasma so as to prevent unwanted oscillations and unwanted plasma waves from destroying the plasma confinement.

U.S. Pat. No. 5,450,223 to Wagner et al. discloses an optical demultiplexer for optical/RF signals. The optical demultiplexer includes an electro-optic modulator that modulates a beam of light in response to a frequency multiplexed radio-frequency information signal.

U.S. Pat. No. 5,489,362 to Steinhardt et al. discloses a plasma discharge tube with a diameter corresponding to a quarter wave length of a standing wave. A waveguide system is dimensioned so that the standing wave forms a first voltage maximum at the first side of the plasma discharge tube. The standing wave is also reflected so it forms a second anti-phase voltage maximum at the second side of the plasma discharge tube. The plasma discharge tube is used in an apparatus for generating excited neutral particles.

U.S. Pat. No. 5,594,456 to Norris et al. discloses an antenna device for transmitting a short pulse duration signal of predetermined radio frequency. The antenna device includes a gas filled tube, a voltage source for developing an electrically conductive path along a length of the tube which corresponds to a resonant wavelength multiple of the predetermined radio frequency and a signal transmission source coupled to the tube which supplies the radio frequency signal. The antenna transmits the short pulse duration signal in a manner that eliminates a trailing antenna resonance signal. However, as with the Moore antenna, the band of frequencies at which the antenna operates is limited since the tube length is a function of the radiated signal.

Notwithstanding the disclosures in the foregoing references, applications for ELF frequencies still use conventional land-based antennas. There remains a requirement for an antenna that can be mast mounted or otherwise use significantly less space than the existing conventional land-based antennas for enabling the transmission of signals at various frequencies, included ELF and other low-frequency signals, for transmission in an underwater environment.

SUMMARY OF THE INVENTION

Accordingly it is an object of the present invention to provide an antenna capable of operation with ELF signals.

Another object of this invention is to provide an antenna that is capable of transmitting signals in different frequency ranges including the ELF range.

Still another object of this invention is to provide an ELF antenna that is transportable.

Yet another object of this invention is to provide an ELF antenna that can be mounted in a restricted volume.

In accordance with this invention, an antenna radiates an electromagnetic field by generating a plasma with an ionizing beam in a longitudinally extending column. The ionizing beam is modulated in response to a modulating signal thereby to develop a modulated current in the longitudinally extending column that radiates electromagnetic energy. A plasma of higher density provides a reflector for the current in the plasma so the antenna operates as a standing wave antenna.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
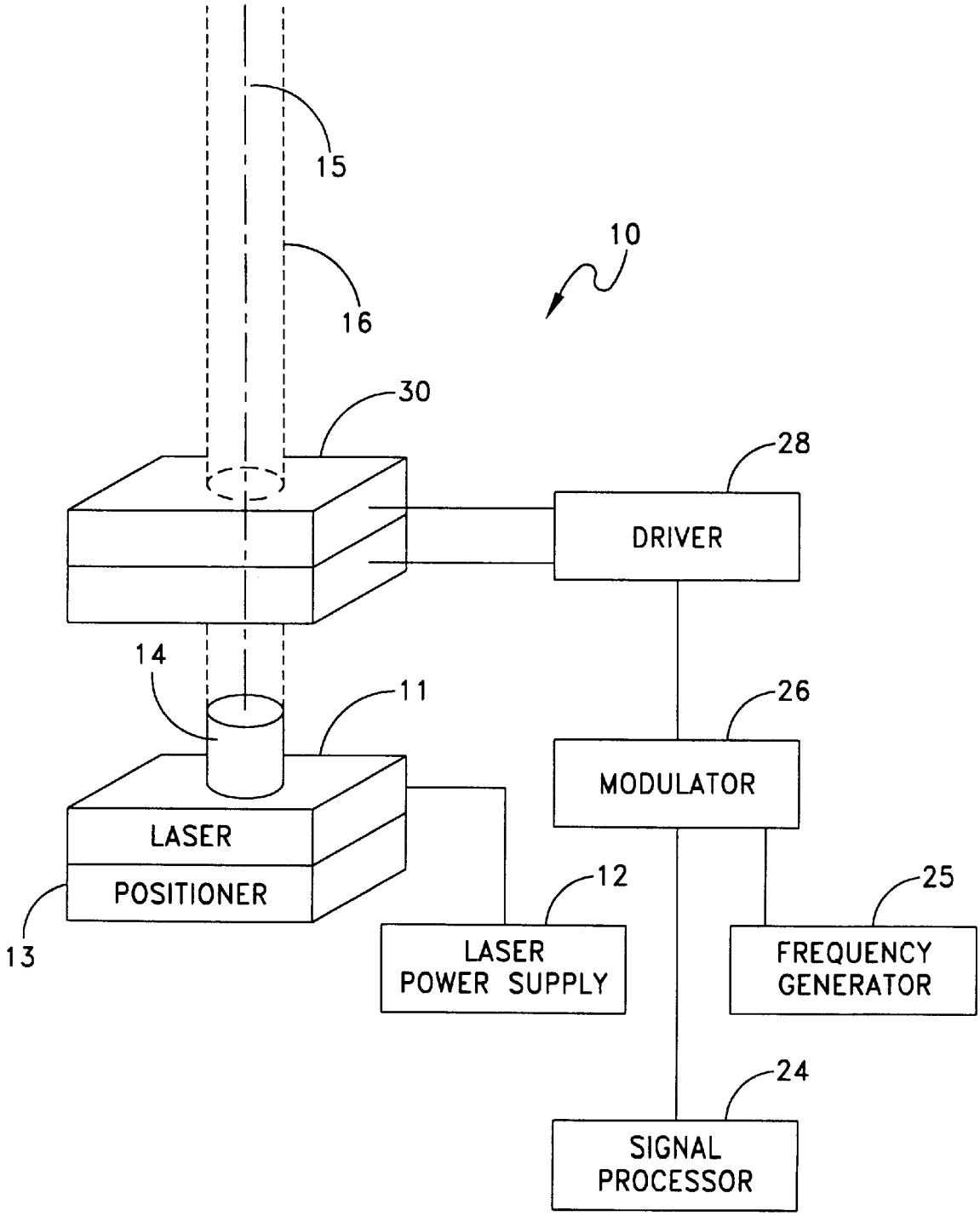
FIG. 1 depicts an embodiment of a plasma antenna.

FIG. 1 schematically depicts a plasma antenna system 10 as more fully described in related application Navy Case No. 78773 entitled PLASMA ANTENNA WITH ELCTRO-OPTICAL MODULATOR. The antenna system 10 includes an ionizing beam generator in the form of a laser 11 operated by a laser power supply 12 acting as an energizer for the ionized beam generator. A positioner 13 locates the laser 11 so that the emitted laser beam from an output aperture 14 travels along a vertical axis 15 into the atmosphere.

When the laser 11 is active, the laser beam interacts with a medium above it to form an unbounded plasma column 16 comprising ions and electrons as known in the art. For ELF applications, the plasma column can extend to the ionosphere.

A basic criterion for providing such an antenna system 10 is that the plasma column 16 have an electron density of at least $10^{12}$ electrons per cubic centimeter in at least a portion of the column. Although it may possible to provide that level of ionization over time intervals associated with ELF frequencies, such continuous wave devices for use in antennas are prohibitively expensive.

Pulse mode lasers offer a better option as ionizers. In FIG. 1 the laser 11 could comprise a $CO_2$, Nd: YAG or other laser. Typically these lasers operate in a pulse mode with a pulse repetition frequency that is much higher than ELF. For example, a $CO_2$ laser may operate with a pulse repetition frequency (PRF) in the megahertz range; one such $CO_2$ laser operates at about 67 MHz with a 33% duty cycle.

Figure 2:
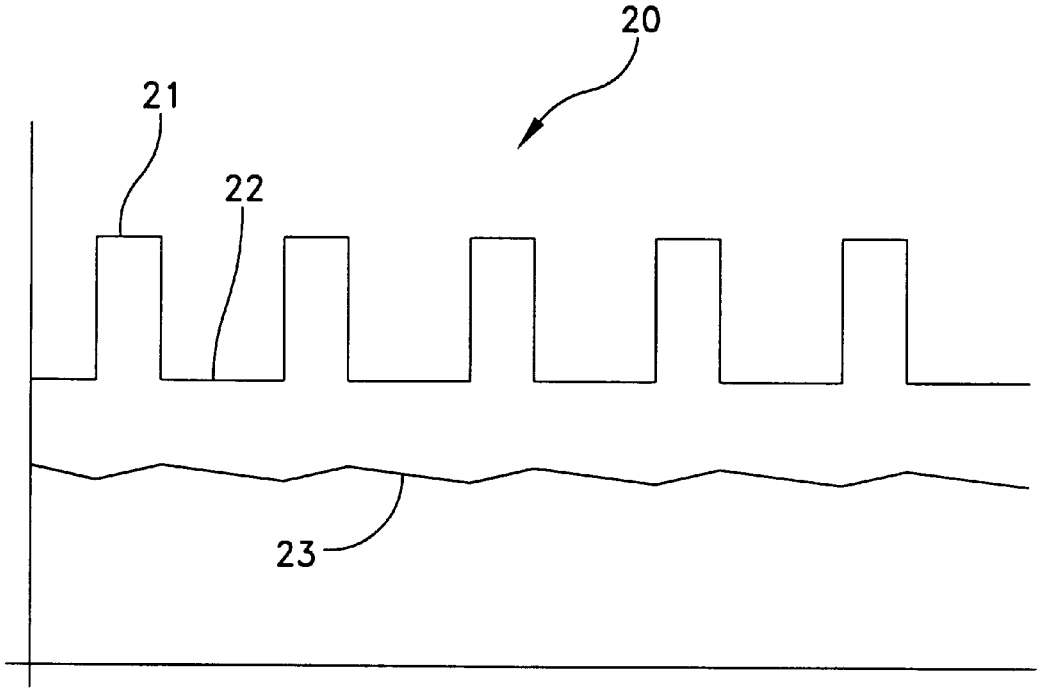
FIG. 2 comprises a set of graphs that are useful in understanding this invention.

As the laser power supply 12 generates continuous pulses, the laser beam ionizes the air in the column 16 to form the plasma. More specifically, FIG. 2 depicts this action by showing a pulse train 20 at some pulse repetition frequency with the pulse train shifting between an ON level 21 and OFF level 22. The OFF time 22, between successive pulses in the pulse train 20 is selected to limit the amount of relaxation between successive pulses. For example, the interval is chosen to limit the relaxation to about 10% of the maximum ionization. A graph 23 in FIG. 2 shows the effect on the level of ionization of repetitive pulses having an OFF time corresponding to above criterion. Although there is a minor variation in the ionization level in the plasma column during successive pulses, that variation is less than about 10% of the maximum ionization. Therefore, the variation is insignificant with respect to the operation of this invention.

FIG. 1 also depicts a signal processor 24 that produces an output signal containing information to be transmitted. A frequency generator 25 provides a carrier frequency in some desired frequency range. This frequency range may be at any frequency including a frequency in the ELF range.

In FIG. 1 a modulator 26 combines the signals from the signal processor 24 and the frequency generator 25 to produce a modulated signal. The signal may be amplitude-, phase- or frequency-modulated. In whatever form, a driver 28 receives the amplitude-, phase- or frequency-modulated signal from the corresponding modulator.

The driver 28 applies a potential to an electro-optical crystal 30. As is generally known, an electro-optical crystal 30 will respond to the signals from the driver 28 by shifting the phase or intensity of the photons in the laser beam. Thus, the introduction of the electro-optical crystal 30 allows the driver to phase-, frequency- or amplitude-modulate the laser beam before the laser beam initiates any significant ionization.

As the modulated laser beam passes through the plasma column 16, it will produce various potential gradients that will cause the charge carriers in the plasma to oscillate at the modulation frequency, e.g., 100 Hz. More specifically, the plasma will undergo changes in frequency or magnitude depending upon a frequency or magnitude of the signal applied by the driver 28.

Assuming that the voltage applied to the electro-optical crystal 30 is an alternating voltage, the currents will be generated in a vertical direction, reversing at the same frequency as the polarity of the signal reverses. Consequently this current generates an AC electromagnetic field that radiates from the column 16 with the frequency determined by the frequency generator 25. Moreover, the intensity or phase of this electromagnetic field will vary in accordance with the amplitude or phase changes produced by the modulating signal from the modulator 26.

At frequencies in the ELF range and other low frequency ranges, a column 16 will effectively be terminated at the ionosphere. However, even at this altitude the plasma column height is less than a quarter wave-length. Thus the antenna must operate in a standing wave mode. In such systems the ionosphere acts as a reflector with respect to the impedance characteristics of the plasma because the density of ions and electrons of the ionosphere is significantly greater than the density of the ions and electrons in the plasma.

Figure 3:
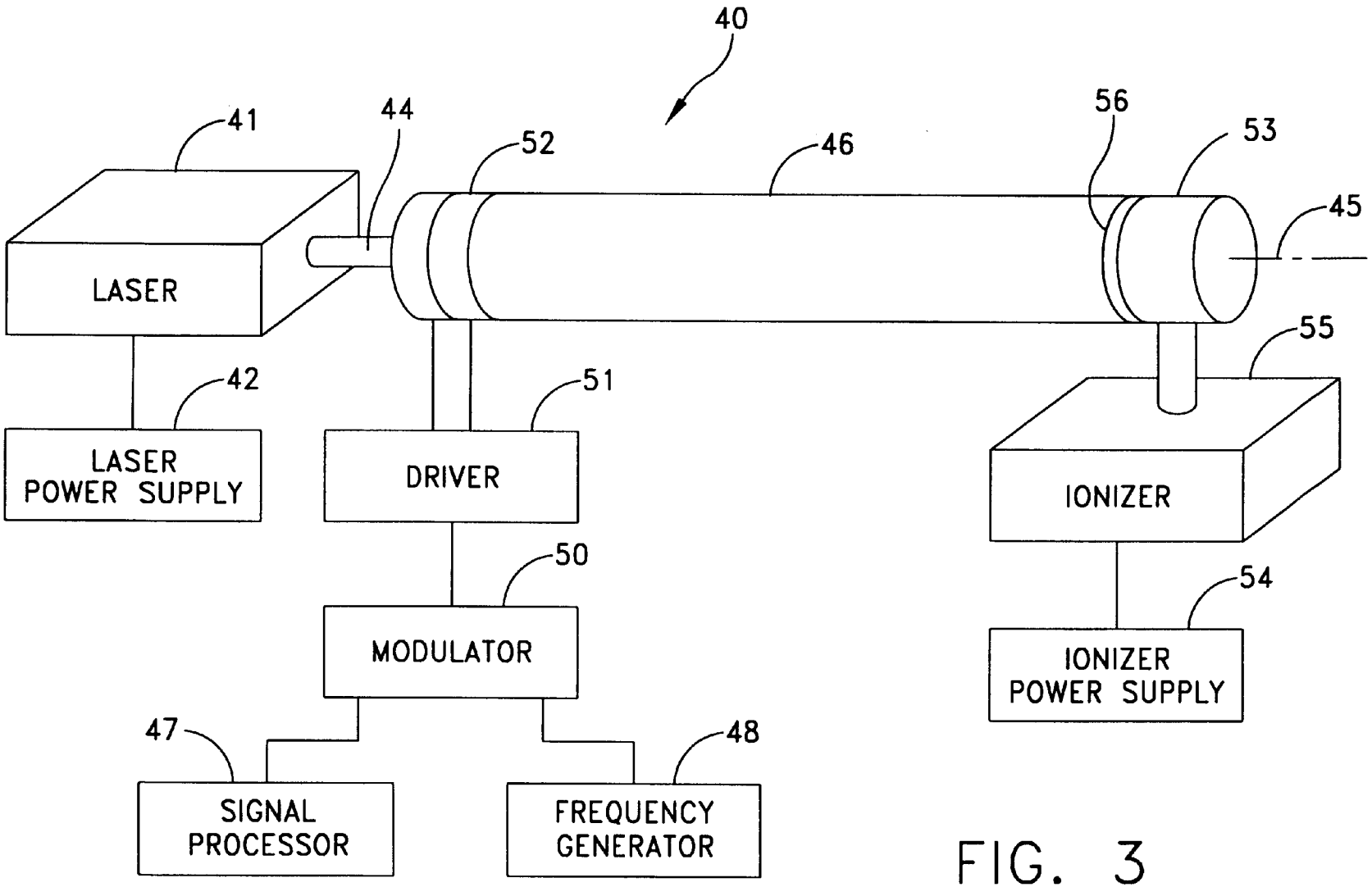
FIG. 3 depicts an embodiment of a plasma antenna according to this invention.

At higher frequencies, it may possible to shorten the antenna. FIG. 3 depicts an antenna system 40 that has such a shortened length and that is constructed in accordance with this invention. In this embodiment the antenna system 40 includes an ionizing beam generator in the form of a laser 41 operated by a laser power supply 42 acting as an energizer for the ionized beam generator. The laser 41 is positioned so that the emitted laser beam from an output aperture 44 travels along an essentially longitudinal axis 45.

In this particular embodiment a tube 46 defines a volume for an ionizable medium, such as the atmosphere or any inert gas. The laser power supply 42 and laser 41 must be selected to provide an electron density of at least $10^{12}$ electrons per cubic centimeter within the tube 46. Like FIG. 1, the apparatus shown in FIG. 3 includes means for modulating the medium within the tube 46. This includes a signal processor 47 and a frequency generator 48. The modulator 50 combines the signals from the signal processor 47 and frequency generator 48 to produce a modulated output signal, that can be amplitude-, phase- or frequency-modulated. The driver or amplifier 51 then applies an amplified signal to an electro-optical crystal 52 that, as previously indicated, shifts the phase or intensity of the photons in the laser beam.

To improve the efficiency of this antenna, a reflector 53 is disposed at a second end of the tube 46 opposite the electro-optical crystal 52. In this particular embodiment reflector 53 is defined as a chamber containing a plasma that has a greater particle density than the plasma within the tube 46 produced by the laser 41. More specifically, an ionizer power supply 54 controls an ionizer 55 to produce such a plasma. The ionizer can be in the form of a laser akin to the laser 41. However, given the volume of the reflector 53, ionization may be obtained by laser, rf, arc discharge or other conventional ionizing mechanisms.

Interaction between the plasma produced in the tube 46 and the plasma in tube reflector/chamber 53 is obtained by incorporating a window 56 that prevents diffusion of one plasma into another. Such windows are well known in the art.

Such an antenna system 40 should produce a current in the plasma within the tube 46 that has a significantly greater magnitude than current in an antenna of conventional design. In accordance with conventional antenna analysis, two antennas provide equal radiation if they have an equal I*L product where I is the current in the antenna and L is the length of the antenna. Assuming the conventional antenna has a length $L_A$, the length $L_P$ of the plasma antenna will be:

$$L_P = \frac{I_A}{I_P} L_A \tag{1}$$

Moreover, at the high and intermediate frequencies utilizing the antenna system shown in FIG. 3 and with the reflection caused by a higher density plasma, the standing wave plasma antenna radiates and receives signals similarly to those in a conventional metallic antenna. However, since the plasma is in a gaseous state, it can be readily changed in shape to accommodate different physical environments and to alter any resonant frequency.

Therefore there has been disclosed in the foregoing figures an antenna in which an ionizing beam generator, such as a laser, produces an ion plasma column. A modulator mechanism, such as an electro-optical crystal, is placed so the laser beam transfers through the electro-optical crystal before entering the ion plasma column. A modulator provides a driving signal to the electro-optical crystal thereby to alter the amplitude or phase of the photons in the laser beam to produce gradients in the ion column. Consequently the ion column produces currents that radiate an electromagnetic field at the frequency of the modulating signal with amplitude-, phase- or frequency variations of the modulating signal. A standing wave is set up in the plasma by having a reflector at the other end of the tube, thus allowing for a shorter length antenna.

As the only hardware associated with the antenna includes the ionizers, electro-optical crystal, signal processor, modulator and electro-optical crystal drivers, this construction provides a compact, transportable antenna structure even for ELF applications. Moreover, this invention enables the construction of an antenna that is significantly shorter than a conventional antenna for the same frequency.

This invention has been described in terms of specific implementations. As stated previously, lasers constitute one of several possible ionizing mechanisms. Different signal processor operations can be incorporated in a plasma antenna that relies upon an electro-optical crystal to modulate a laser beam thereby to produce currents that are radiated in an alternating electromagnetic field as an amplitude or a phase modulated field having a frequency determined by the modulating signal. Therefore, it is the intent of the appended claims to cover all such variations and modifications as come within the true spirit and scope of this invention.

What is claimed is:

1. An antenna comprising an ionizing beam generator for directing an ionizing beam along an axis;

means for energizing said ionizing beam generator thereby to produce a longitudinally extending plasma column along the axis;

modulating means disposed in the ionizing beam intermediate one end of said ionizing beam generator and the plasma column for modulating the ionizing beam thereby to produce a modulated current in the vertically extending plasma column that radiates electromagnetic energy; and reflector means at the other end of said ionizing beam generator for reflecting the modulated current therefrom whereby said antenna operates as a standing wave antenna.

2. An antenna as recited in claim 1 wherein said ionizing beam generator comprises a laser.

3. An antenna as recited in claim 1 wherein:

said ionizing beam generator comprises a laser that, when operated by said energizing means, generates a plasma in at least a portion of the column with a concentration of at least $10^{12}$ electrons per cubic centimeter; and said reflector means comprises a chamber containing a plasma that has a greater density than the plasma in the plasma column.

4. An antenna as recited in claim 3 wherein said reflector means includes means for generating the plasma in said chamber.

5. An antenna as recited in claim 4 wherein said reflector means plasma generator comprises a plasma generator taken from the group of laser, electric discharge and radio frequency plasma generators.

6. An antenna as recited in claim 5 wherein said reflector means plasma generator comprises a laser and wherein said each of said lasers is taken from the group of $CO_2$ and Nd:YAG lasers.

7. An antenna as recited in claim 3 further comprising a window separating said reflector means plasma from said plasma column.

8. An antenna as recited in claim 1 wherein said modulating means comprises:

means for generating a modulating signal;

electro-optical crystal means disposed to intercept the laser beam between said laser and said column; and a modulator circuit responsive to the modulating signal for energizing said electro-optical crystal means in response thereto whereby said electro-optical crystal means introduces gradients in the plasma that cause charge carriers in the plasma to oscillate parallel to the axis and radiate electromagnetic energy from the antenna, said currents being reflected from said reflector means.

9. An antenna as recited in claim 8 additionally comprising means between said modulating means and said reflector means for defining a bounded plasma column.

10. An antenna as recited in claim 9 wherein:

said ionizing beam generator comprises a laser that, when operated by said energizing means, generates a plasma column with a concentration of electrons of at least $10^{12}$ electrons per cubic centimeter in at least a portion of the column; and said reflector means comprises a chamber containing a plasma that has a greater density than the plasma in the plasma column.

11. An antenna as recited in claim 10 wherein said reflector means includes means for generating the plasma in said chamber.

12. A method for radiating electromagnetic energy in response to a signal comprising the steps of;

directing an ionizing beam along an axis;

energizing the ionizing beam thereby to produce a longitudinally extending plasma column along the axis having first and second ends thereof;

modulating the ionizing beam intermediate one end of said plasma column thereby to produce a modulated current in the plasma column that radiates electromagnetic energy; and producing a reflecting medium at the second end of the plasma for reflecting the modulated current therefrom whereby the plasma column operates as a standing wave antenna.

13. A method as recited in claim 12 wherein said step of direction an ionizing beam includes the step of directing a laser beam along the axis.

14. A method as recited in claim 12 wherein:

said step of directing an ionizing beam includes the step of directing a laser beam along the axis to produce a plasma in at least a portion of the column with a concentration of at least $10^{12}$ electrons per cubic centimeter; and said reflection producing step includes the step of locating plasma at the second end of the column that has a greater density than the plasma in the plasma column.

15. A method as recited in claim 14 wherein said step of producing the plasma at the second end includes the step of generating the plasma with an ionizing beam produced by a plasma generator taken from the group of laser, electric discharge and radio frequency plasma generators.

16. A method as recited in claim 12 wherein said modulating step includes:

generating a modulating signal;

interposing an electro-optical crystal means in the ionizing beam to intercept the beam; and controlling the electro-optical crystal means in response to the modulating signal whereby the electro-optical crystal means introduces gradients in the plasma that cause charge carriers in the plasma to oscillate parallel to the axis and radiate electromagnetic energy from the antenna, said currents being reflected from the reflecting medium.

17. A method as recited in claim 16 additionally comprising the step of enclosing the plasma column.

18. A method as recited in claim 17 wherein:

said steps of directing and energizing an ion beam include energizing a laser to produce a plasma column with a concentration of electrons of at least $10^{12}$ electrons per cubic centimeter in at least a portion of the column; and said reflection producing step includes the step of locating plasma at the second end of the column that has a greater density than the plasma in the plasma column.

19. A method as recited in claim 18 wherein said reflector means includes means for generating the plasma at said second end.

* * * * *